United States Patent [19]

Arnau-Munoz et al.

[11] Patent Number: 4,874,107

[45] Date of Patent: Oct. 17, 1989

[54] MULTIPLE COMPARTMENT CONTAINER

[75] Inventors: José L. Arnau-Munoz, Montigny-Le-Bretonneux; Henri Cornette, Pontoise, both of France

[73] Assignee: The Procter & Gamble Company, Cincinnati, Ohio

[21] Appl. No.: 173,490

[22] Filed: Mar. 25, 1988

[30] Foreign Application Priority Data

Mar. 25, 1987 [FR] France ..... 87 04168

[51] Int. Cl.[4] ..... B65D 25/00

[52] U.S. Cl. ..... 220/20; 220/404

[58] Field of Search ..... 220/20, 20.5, 22.1, 220/403, 404, 426; 206/219, 221, 568, 594

[56] References Cited

U.S. PATENT DOCUMENTS

| | | | |
|---|---|---|---|
| 2,205,147 | 6/1940 | Madsen | 225/26 |
| 2,321,998 | 6/1943 | Crouch et al. | 215/6 |
| 2,661,870 | 12/1953 | Huenergardt | 222/129 |
| 2,939,610 | 6/1960 | Castelli et al. | 222/94 |
| 2,944,704 | 7/1960 | Taylor | 222/94 |
| 3,052,371 | 9/1962 | Van Bemmelen | 220/20 |
| 3,070,275 | 12/1962 | Bostrom | 220/20 X |
| 3,135,428 | 6/1964 | Gallo, Sr. | 222/94 |
| 3,163,544 | 12/1964 | Valyi | 220/404 X |
| 3,200,995 | 8/1965 | Gangwisch | 222/94 |
| 3,217,931 | 11/1965 | Farrar et al. | 222/94 |
| 3,289,887 | 12/1966 | Farrar et al. | 222/1 |
| 3,467,269 | 9/1969 | Newton | 220/20 X |
| 3,504,384 | 4/1970 | Radley et al. | 4/228 |
| 3,741,383 | 6/1973 | Wittwer | 220/20 X |
| 3,850,346 | 11/1974 | Richardson et al. | 222/145 |
| 4,022,351 | 5/1977 | Wright | 222/145 |
| 4,089,437 | 5/1978 | Chutter et al. | 222/94 |
| 4,330,066 | 5/1982 | Berliner | 220/404 X |
| 4,678,103 | 7/1987 | Dirksing | 222/130 |

FOREIGN PATENT DOCUMENTS

| | | |
|---|---|---|
| 0132726 | 2/1985 | European Pat. Off. . |
| 0152359 | 8/1985 | European Pat. Off. . |
| 2939116 | 4/1981 | Fed. Rep. of Germany . |

*Primary Examiner*—Steven M. Pollard

*Attorney, Agent, or Firm*—R. C. Witte; J. V. Gorman; M. E. Hilton

[57] ABSTRACT

The invention is a single use container having an outer enclosure and an inner compartment isolated therefrom and is advantageous for the machine washing of laundry using detergent compositions having mutually incompatible constituents. Through an opening, the inner compartment receives a constituent of a detergent composition, such as a peroxidic additive. The outer enclosure receives another constituent of the detergent composition through a separate opening. For storage and for sale, a hood crowns the upper part of the container sealing the openings of the enclosure and compartment, thereby isolating the constituents of the enclosure and compartment. With the hood removed, the container is inserted into the drum of a washing machine. Simultaneous and gradual release of the constituents within the enclosure and compartment occurs during the washing operation.

15 Claims, 4 Drawing Sheets

MULTIPLE COMPARTMENT CONTAINER

FIELD OF INVENTION

The present invention belongs to the field of packaging and relates more particularly to a single-use container for packaging substances which do not exhibit satisfactory compatibility when brought together. Such containers are capable of receiving many applications in a wide variety of technical fields, for example the washing, cleaning or rinsing of the most diverse articles. A highly preferred application of the container according to the invention is that of the machine washing of laundry. Furthermore, another subject of the invention is the process for producing a container of this kind.

BACKGROUND OF THE INVENTION

There is a growing technological need for means of packaging capable of combining substances whose compatibility raises difficulties when they are brought into contact. This is particularly the case with liquid products such as washing aids. Although it is possible to package the constituents of a powdered washing aid in the same container, it is not permissible in practice to formulate liquid washing aids beforehand when some of the constituents are capable of releasing active oxygen, that is to say peroxidic constituents of the perborate or organic peroxyacid type. It is known, however, that the presence of active oxygen at the time of washing is wholly desirable for obtaining the optimum effectiveness. In the case of liquid washing aids attempts are therefore made to produce formulations containing the same basic combinations as those in the granular or powdered detergents, but practical impossibilities then stand in the way because it is known that when traditional active compounds and peroxidic compounds are incorporated together within a liquid washing aid, the latter compounds rapidly lose their effectiveness. Thus, it has been found that after storage periods of the order of two weeks the active oxygen of these compounds has been practically completely released, thus becoming unavailable at the time of use in the wash bath.

Formulation and packaging problems of this kind are well known to the specialist. By way of reference to illustrate the state of the art there may be mentioned the European Patent Application published under No. 0,132,726, which describes a package in the form of a sachet containing a substance as well as another sachet of smaller size containing another substance which is incompatible with the first. The material of which the outer sachet is made is water-permeable, as is that of the inner sachet, but the materials are chosen to permit the diffusion of the substances which they contain at different temperatures, and this permits the packaging to be adapted to practical needs, for example of washing. The teaching of this prior document thus consists in presenting in the same packaging individual sachets which can contain liquid substances, while choosing the sachets so that they release the substances they contain at different temperatures. Such packaging containers are single-use and comprise a plurality of compartments, the basic concept resulting in a use, necessarily spaced out in time, of the substances present in each of the individual sachets. Furthermore, it is essential that the latter be soluble in water or have individual properties in order to allow water to pass through at a specific temperature. This is why the outer sachet is made from a sheet of open-pore polyurethane foam, whereas the inner sachet is made of polyvinyl alcohol.

The subject of the invention is a single-use multicompartment container which enables the contents of each of the compartments to be delivered simultaneously, at the time of use, independently of the temperature of the surroundings. Similarly, the materials of which the walls of the compartments are made are of no critical importance and, in contrast to the teaching of the above mentioned European Patent Application No. 0,132,726, these walls are impervious to water, the contents of each of the compartments being discharged through orifices which are provided beforehand.

It will also be recalled that, in the field of machine washing of laundry, the Applicant Company is already the owner or titleholder of a number of patent applications which may be mentioned by way of references to illustrate the state of the art.

The application FR No. 84/06,151, filed on Apr. 18, 1984, for "Process for washing linen in a machine with a liquid detergent and device for its aplication" relates particularly to a device, generally reloadable, which is firstly filled with liquid detergent and is then placed in the drum of the machine with the laundry to be washed. The detergent contained in the device diffuses gradually into the washing medium and into the laundry placed in the machine. In one embodiment, the device comprises a filling orifice and vents for the gradual release of the liquid within the laundry being washed.

Patent application FR No. 84/13,210, filed on Aug. 24, 1984 for "Device for washing in a machine with a liquid detergent and process employing the said device" relates to a device of the above type which is more particularly characterized in that it is of substantially spherical shape. A certain number of orifices allow the liquid to diffuse.

Continuing its work, the Applicant Company has now developed a container while, on the one hand, is single-use and, on the other hand, provides a solution to the technical problems briefly referred to above for packaging substances which do not exhibit satisfactory compatibility when they are brought together. A particularly advantageous application of the container according to the invention is the packaging of liquid washing aid formulations containing peroxidic constituents, that is to say constituents intended to release active oxygen during the washing.

BRIEF SUMMARY OF THE INVENTION

The invention is therefore a single-use container for packaging substances which do not exhibit satisfactory compatibility when brought together. The container comprises a generally rigid outer enclosure, defining a compartment having an opening and adapted to hold a liquid. The container also has at least one expandable inner compartment generally within the outer enclosure. The inner compartment has an orifice disposed peripherally to all of the compartments and is adapted to hold a liquid. The inner compartment has a transverse dimension which is adapted to allow the inner compartment to pass through the orifice of the outer enclosure when the inner compartment is unexpanded. The transverse dimension of the inner compartment is greater than the dimension of the opening when the inner compartment is expanded.

BRIEF DESCRIPTION OF THE DRAWINGS

The invention will be illustrated further, without being limited in any manner, by the description which follows and which is given with an example of use of a single-use, multi-compartment container, with reference to the attached drawings, in which.

DETAILED DESCRIPTION OF THE INVENTION

Figure 1:
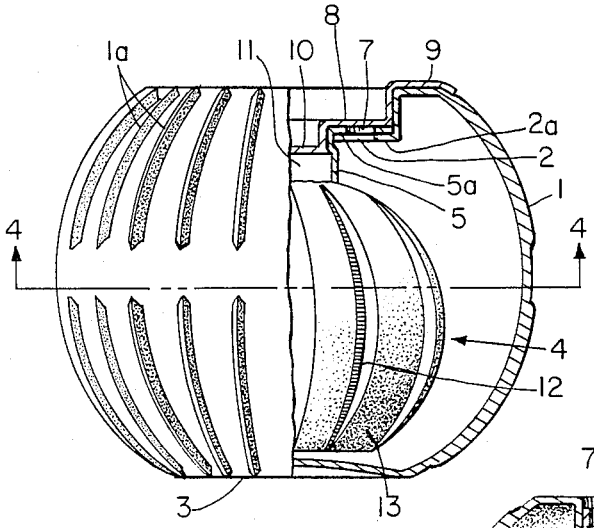
FIG. 1 is a partial vertical sectional view of an embodiment of the container of the present invention, with the protective hood in place.

The container has, overall, an outer enclosure defining a compartment of overall spherical shape and capable of receiving a first substance (or mixture of mutually compatible substances) and at least one compartment capable of receiving a second substance (or mixture of mutually compatible substances) which is relatively incompatible with the first. Each compartment has one or more holes, or orifices, peripheral to all compartments of the container. The contents of the compartments are isolated from each other when a closure, or hood, is placed in position. When the hood is removed, the substance in the inner compartment can flow freely through an orifice in the latter and the substance in the outer compartment can flow freely through holes, so that all the substances held in the container are then available together.

Within the meaning of the present description, the expression "of overall spherical shape", which is employed to define the outer enclosure of the container should not be understood as characterizing solely a sphere or a virtual sphere. This expression includes other surfaces of revolution of the ovoid type, whose curvatures are such that the container does not cause any damage to the laundry in a machine washing operation during which the container is placed in the drum.

The inner compartment, for its part, may be bounded by a wall of any shape but, bearing in mind the preferred technology employed for its manufacture and described hereinafter, it is generally a surface of revolution, of the spherical or ovoid type.

It is advantageous for the outer enclosure to have corrugations, or ribs, external to the enclosure, to add rigidity as is known in the field of plastics, particularly when the latter are fabricated by a blowing method.

According to another preferred characteristic, the inner compartment comprises bellows which provides flexibility to the inner compartment.

The materials of which the outer enclosure and the inner compartment are made may be identical or different. It is preferable that these materials should be chosen so that the outer enclosure and the inner compartment have different rigidities, for example that the outer enclosure should be made of a material of higher rigidity than that of the inner compartment and vice versa. Thus, while the materials chosen for the two components belong to the same category of plastics, it is advantageous that the materials corresponding to the two components should differ in their rigidity.

The plastics which can be employed are those which can be fabricated using the blowing or injection blow-molding technology but, given that the container is designed for a single use, the walls corresponding to the outer enclosure and the inner compartment should be made as thin as possible, so that the total weight of the container should also be as low as possible. Wall thicknesses of the order of about 0.3 to 1 mm are suitable. The preferred materials are chosen from polypropylenes, polycarbonates and polyethylenes, or combinations of these materials, with or without adjuvants.

From another aspect, another subject of the invention is a process for producing the container such as defined above, by the general technology of blowing or injection blow-molding of plastics, characterized in that it comprises the following series of steps:

(1) the body of the outer enclosure with its circular opening and its flat bottom is fabricated, (2) the said enclosure is filled with the desired quantity of the first substance, (3) an insert equipped with a plastic sheath is inserted through the said opening until the upper part of the sheath, of annular shape, comes to bear substantially on the the edges of the opening in the enclosure, (4) the sheath is used to fabricate the inner compartment of the container, (5) holes are pierced in the annular region formed in the upper part of the inner compartment, (6) the inner compartment is filled with the desired quantity of the second substance, and (7) the upper part of the container is crowned with the hood.

The process described above may involve numerous alternative forms which differ in some of their steps or in the series of the steps.

Thus, according to a first alternative form, another subject of the invention is a process for producing the containers such as defined above, comprising the following series of steps:

(1a) the body of the outer enclosure with its circular opening and its flat bottom is fabricated, (2a) an insert equipped with a plastic sheath is inserted through the opening until the upper part of the sheath, of annular shape, comes to bear substantially on the edges of the opening in the enclosure, (3a) the sheath is used to fabricate the inner compartment of the container, (4a) holes are pierced in the annular region formed in the upper part of the inner compartment, (5a) the body of the enclosure is filled with the desired quantity of the first substance by introducing the latter through the holes produced in step (4a).

(6a) the inner compartment is filled with the desired quantity of the second substance, the latter being introduced through the circular opening in the said compartment, and (7a) the upper part of the container is crowned with the hood. In the above mentioned first alternative form it is clear that the order of steps (5a) and (6a) may be reversed.

In a second alternative form, which corresponds to a particularly advantageous way of practical implementation, the process of the invention comprises the following steps:

(1b) the body of the outer enclosure with its circular opening and its flat bottom is fabricated, (2b) an insert equipped with a plastic sheath whose upper part of annular shape has holes made beforehand is inserted through the opening until the upper part comes to bear substantially on the edges of the opening in the enclosure, (3b) the sheath is used to fabricate the inner compartment of the container, (4b) and (5b) the body of the enclosure and the inner compartment are filled with the respective desired quantities of the first and second substance, and (6b) the upper part of the container is crowned with the hood.

In this second alternative form, just as in the first, the steps (4b) and (5b) may be in any order.

Whatever the way of implementing the process of the invention, the fabrication of the inner compartment may be performed in a number of ways.

According to the first way, in step (3) or (2a) or (2b), an insert is introduced which is equipped with a sheath of supple plastic, the interior of which is evacuated to shrink the insert so as to enable it to pass easily through the circular opening in the outer enclosure produced in step (1) or (1a) or (1b), after which the vacuum inside the sheath is broken when the upper part of the latter bears on the edges of the opening and the sheath is used to fabricate the inner compartment using blowing (or injection blow-molding) technology.

According to the second way, in step (3) or (2a) or (2b) an insert is introduced which is equipped with a plastic sheath whose rigidity and transverse size allow it to pass through the circular opening in the outer enclosure produced in step (1) or (1a) or 1(b), after which the sheath is used to fabricate the inner compartment directly using blowing (or injection blow-molding) technology. This second way is advantageous, because it makes it possible to do away with the steps of evacuating the sheath and subsequently breaking the vacuum before the blowing operation.

Regardless of which process is used to fabricate the inner compartment, the inner compartment has a transverse dimension, or cross sectional area, which is sufficiently small to allow the inner compartment to pass through the opening of the outer enclosure when the inner compartment is not expanded. When the inner compartment is expanded, for example to hold a liquid detergent, the transverse dimension of the inner compartment is greater than the transverse dimension of the opening of the outer enclosure, preventing the inner compartment from passing therethrough.

The process according to the invention and its alternative forms make it possible to produce a container which is prefilled with substances which are not mutually compatible, the container being for single use.

In practice, the process is carried out automatically by starting with the use of sheets of plastic enabling a plurality of outer enclosures, for example six enclosures, distributed symmetrically around a central axis, to be made in a single operation. The mechanical strength of the unit is then improved and the handling operations are easier, by virtue of the fact that the outer enclosures are all integrally connected to a sheet remaining plate-shaped overall.

If a plurality of outer enclosures is employed, it is obviously necessary to employ a corresponding number of inserts and of sheaths intended to form inner compartments by means of a blowing operation.

As mentioned earlier, it is preferable to employ corrugated molds in the blowing operations, in order to produce more rigid outer enclosures having external ribs. It is also advantageous that the plastic sheath intended to form the inner compartment should incorporate axially aligned folds or bellows enabling the inner compartment to be increased in capacity by permitting the transverse dimension of the inner compartment (4) to expand as the inner compartment (4) converts from its unexpanded position to its expanded position.

A container of the above mentioned type, or produced using the process just described, makes it possible to package substances which are not sufficiently compatible with each other to permit storage conditions which correspond to practical needs. As an example, a sensitive additive for a liquid washing aid may be introduced into the inner compartment, for example an additive based on peroxidic compounds, while the remainder of the formulation of the liquid washing aid is placed in the outer enclosure outside this inner compartment.

The description given above is essentially that of the construction of a container having two compartments but, needless to say, the same fabrication technology may be employed to produce successive inner compartments. It suffices to provide the appropriate number of inserts with plastic sheaths in order to produce each compartment. The characteristic which is common to all these compartments is that they have holes, or vents, which are organized so that when the hood covering the whole is removed, the respective contents of these compartments can flow freely.

To simplify matters, no indication has been given in the process described above of the consecutive steps which may become necessary if the work is done with sheets or plates permitting the simultaneous fabrication of a plurality of containers. It goes without saying, in fact, that once each of the individual containers has been crowned with its hood, the container needs to be separated from its support plate, for example by being punched out, and this may also result in the need to remove the parts of the cut plate which remain integrally attached to the outer wall of the containers. An operation of this kind can be carried out using a flame. Lastly, the containers may be grouped together for packaging in cardboard boxes.

The specialist will understand that the containers according to the invention are capable of finding all kinds of applications which require the use of substances which are poorly compatible or incompatible with each other, and which need to be delivered simultaneously in a washing, rinsing, cleaning or similar operation. A particularly advantageous application consists in using such containers in a machine laundry washing process described in the above mentioned French Patent Applications Nos. 86/06,151 of Apr. 18, 1984 and 84/13,210 of Aug. 24, 1984. The container according to the invention then acts as a dispensing and distributing device in accordance with the teaching of these patent applications. For example, in the case of a container with two compartments, the inner compartment contains an additive based on peroxidic compounds, while the other compartment contains the remainder of the formulation of the liquid detergent. Once the hood crowning the container has been removed, the container is placed in the drum of the machine with the laundry to be washed. The detergent and the additive which are held therein diffuse gradually into the washing medium and into the laundry which is in the machine, and this takes place simultaneously, by virtue of the gradual outflow of the detergent and of the additive. Optimum results for the washing of laundry are thus produced.

Bearing in mind that the container according to the invention is intended to be used once, it is generally incapable of being reused and, in particular, at the end of the a machine washing cycle, once the products (washing aid and additive) have completely left their respective compartments, the whole container is generally deformed, but its constituent parts nevertheless remain integrally attached to each other, and this makes it possible, on the one hand, not to damage the laundry and, on the other hand, not to produce bits capable of blocking the pipework. Thus, once the washing of the laundry is finished, the container is recovered from the drum of the machine, generally in a collapsed shape.

As already said, the washing process according to the invention is thus preferably employed with a single-use, multi-compartment container. However, the process may also employ containers of different design, comprising compartments separated by walls which are impervious to the aqueous medium and to the liquid products which are usually employed in the technology of washing. In fact the process according to the invention is based on a directed diffusion through the openings with which the compartments are respectively provided.

For ease of description, the container has first of all been shown in FIGS. 1 to 6 without reference being made to substances which it contains. The production of a complete container is illustrated in FIGS. 7 to 12, with FIG. 12 in particular showing a single-use container with two compartments, and the protective hood removed.

As illustrated in FIG. 1, the container comprises an outer enclosure (1) defining a compartment of overall spherical shape having a flat bottom (3) with a circular opening (2) diametrically opposed to the bottom (3). This circular opening (2) is bounded by an annular surface (2*a*) lying in a plane substantially parallel to that of the bottom (3). This enclosure may have a thickness of, for example 0.5 mm and may be made of polyethylene, polypropylene, polycarbonate and combination of such polymers, with or without adjuvants. To make the wall (1) sufficiently rigid, its outer periphery is provided with corrugations (1*a*), or ribs, which can be seen in the left half of FIG. 1 and in FIG. 2.

Figure 3:
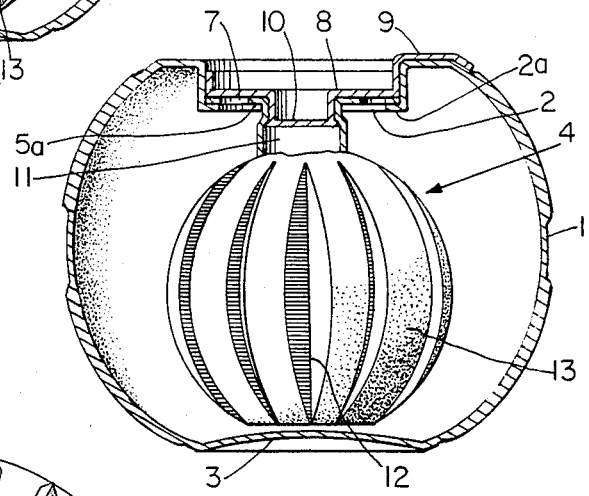
FIG. 3 is a partial vertical sectional view of the container of FIG. 1, taken along line 3—3 of FIG. 2.
Figure 2:
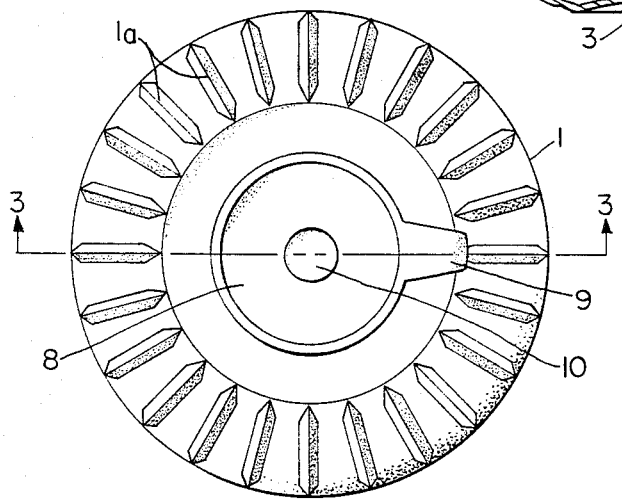
FIG. 2 is a top plan view of the container of FIG. 1.
Figure 4:
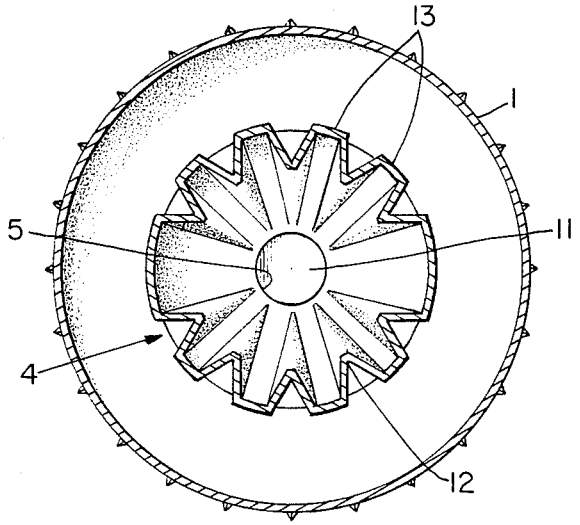
FIG. 4 is a horizontal sectional view of the container of FIG. 1, with the protective hood removed, taken along line 4—4 of FIG. 1.
Figure 6:
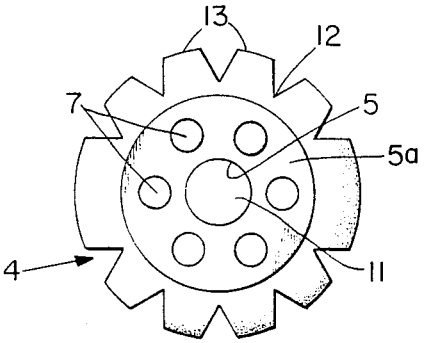
FIG. 6 is a top plan view of the inner compartment of the container of FIG. 1.

The container also comprises a separate inner compartment indicated generally by reference (4) and situated wholly inside the outer enclosure (1). This compartment is illustrated in the right-hand side of FIG. 1, and in FIG. 3. The compartment (4) has a wall forming bellows (12). In the upper part of the inner compartment (4), as seen in FIG. 3, a cylindrical wall (5) is arranged and this extends firstly vertically and then horizontally to come to bear (flange (5*a*)) on the edges of the opening (2) of the outer enclosure (1) which in this case is the annular rim (2*a*). Consequently, the annular flange (5*a*) adjoins the edges of the opening (2) by bearing upon the annular rim (2*a*). The inner compartment (4) is thus open near the top via orifice (11), of circular cross-section. Similarly, a plurality of holes (7) (these holes are six in number in the example shown) which access the interior of the outer enclosure (1) are distributed uniformly in the annular flange (5*a*) encircling the mouth of the central orifice (11) as shown in FIGS. 4 and 6.

Figure 5:
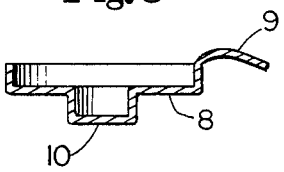
FIG. 5 is a vertical sectional view of the protective hood.

The container is closed by a protective stopper which is illustrated in FIG. 5. This stopper has a cylindrical projection (10) which fits into the orifice (11) of the inner compartment (4). This projection (10) is connected to a wall (8) which is applied onto the annular flange (5*a*), in order to close the holes (7) made in the latter. Lastly, the stopper ends in a small tongue (9) which enables the stopper to be manipulated.

The materials of which the inner compartment (4) is made are chosen from the same polymers as those of the outer enclosure (1) but it is preferable that they should have different rigidity characteristics when compared with these.

When the container is empty, its average weight is of the order of 8 to 15 g.

The operation of a single-use container capable of being used in the process of the invention will now be described, with reference to FIGS. 7 to 12.

Figure 7:
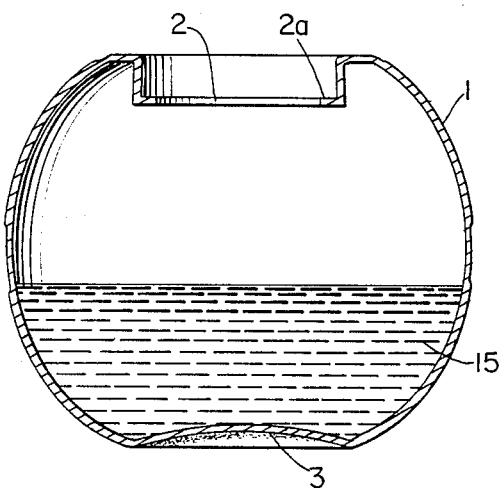
FIG. 7 is a vertical sectional view of the outer enclosure when partially filled with a liquid.

To avoid increasing the number of figures, not all of the stages of the process have been illustrated in the drawings. For example, FIG. 7 shows the body (1) of the outer enclosure which is produced by blowing or injection blow-molding with its top opening (2) bounded by the annular rim (2*a*) and its flat bottom (3). The same FIG. 7 shows a liquid product (15) which has been introduced into the enclosure (1) once the latter has been produced. The product (15) is, for example, a liquid detergent formulation not containing an additive of the type of peroxidic compounds. The volume of the enclosure (1) and the quantity of liquid product (15) are calculated relative to each other, bearing in mind that the container is designed to receive a single dose with a view to a subsequent operation of washing laundry. The quantity of liquid (15) must therefore be sufficient to ensure this function, the volume of the enclosure (1) being sized so as to enable the other steps to take place in succession.

Figure 8:
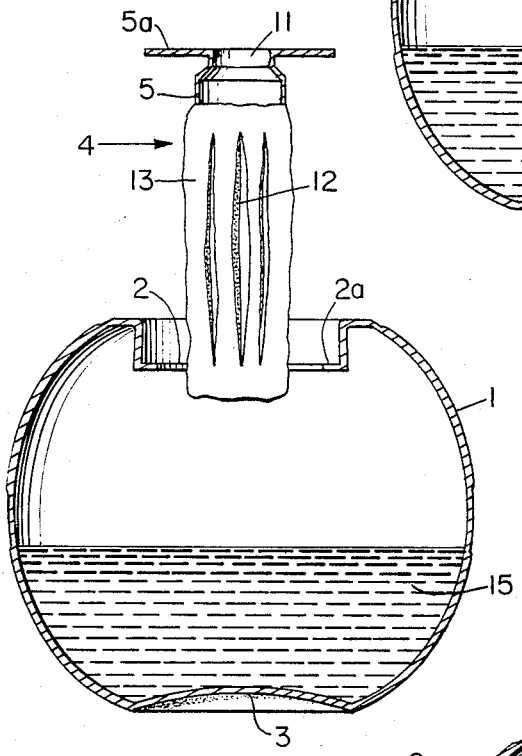
FIG. 8 is a partial vertical sectional view of the inner compartment being inserted into the outer enclosure which is shown in vertical section.

FIG. 8 illustrates the beginning of installation of an insert bearing a plastic sheath (13). The cross-section of the sheath (13) is smaller than the diameter of the opening (2). In order to make the insertion possible, a vacuum or a suction may be applied to the interior of the sheath (13), through the upper opening (11). The sheath (13) preferably includes a bellows structure (12). In its upper part, the sheath (13) is joined to a cylindrical portion (5) to which is attached a wall (5*a*) in the form of a flange, in the middle of which is the orifice (11).

Figure 9:
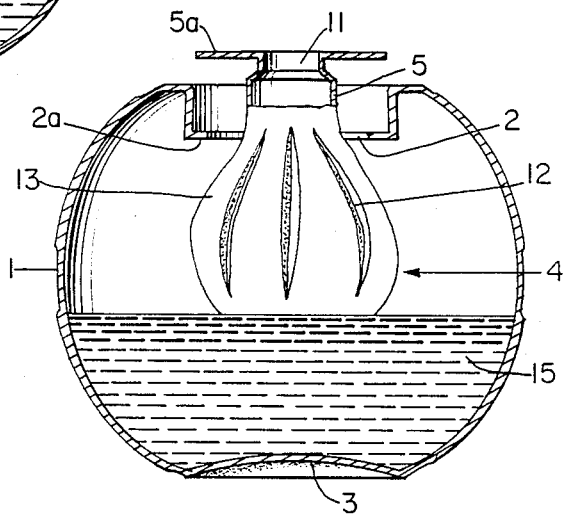
FIG. 9 is a partial vertical sectional view of the inner enclosure reaching the level of the liquid in the outer enclosure, which is shown in vertical section.
Figure 10:
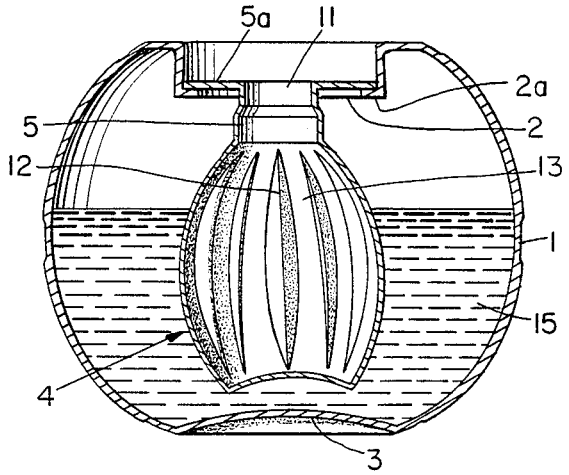
FIG. 10 is a vertical sectional view of the assembled container, showing the inner compartment within the liquid contained by the outer enclosure.

FIG. 9 illustrates the progress of insertion of the sheath (13) into the enclosure (1). It can be seen that the flange (5*a*) is sized so as to cover virtually the whole of the opening (2) until the arrangement shown in FIG. 10 is reached, where it can be seen that the flange (5a) comes to bear on the annular rim (2a) of the enclosure (1). When this situation is reached, the vacuum which may have been applied to the interior of the sheath (13) is broken. This interruption of suction may take place when the flange (5a) is actually bearing on the annular rim (2a), but it is also possible, as shown in FIGS. 9 and 10, for the suction to be cut off as soon as the cylindrical part (5) has moved past the opening (2) in the outer enclosure (1), so that a blowing operation may commence inside the sheath (13) as soon as the situation illustrated in FIG. 10 is reached.

Figure 11:
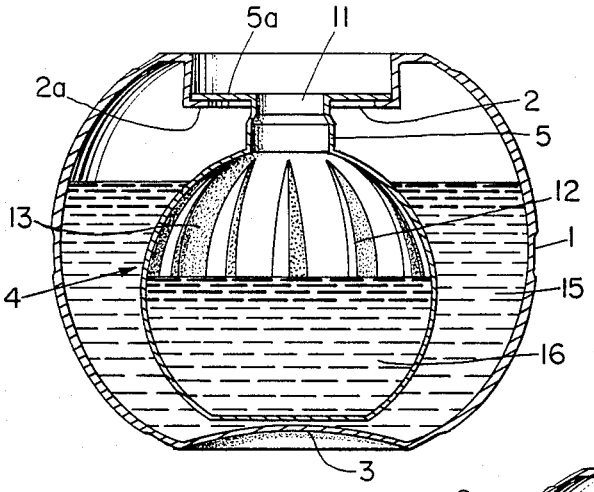
FIG. 11 is a vertical sectional view of the assembled container; showing the inner compartment to be partially filled with a liquid.

This leads to the situation shown in FIG. 11, where the sheath (13) has given rise to the inner compartment (4) in its final form. This same FIG. 11 shows the consecutive operation which consists in filling the inner compartment (4) with a liquid (16) which is introduced through the orifice (11). In the case of a liquid detergent for machine washing of laundry, this product (16) may be an additive of the peroxidic type.

Figure 12:
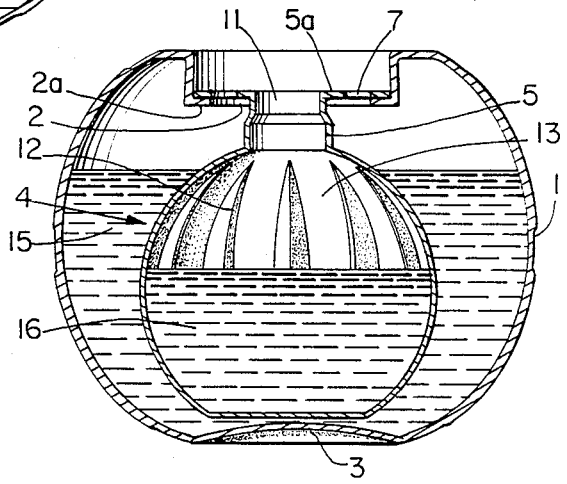
FIG. 12 is a vertical sectional view of the container of FIG. 11, showing holes in the annular region of the upper part of the inner compartment.

The operation illustrated in FIG. 12 is that of piercing the holes (7) in the flange (5a) situated in the upper part of the inner compartment (4). Six holes (7) for example, are pierced to produce an inner compartment such as illustrated in FIGS. 6 and 12, although a different number of holes may be employed.

Lastly, the upper part of the container is crowned with a hood of the type shown in FIG. 5.

Thus, the final product is a single-use container, with a double compartment, an inner compartment (4) in which there is an additive of the peroxidic type, and a second compartment, outside the compartment (4), which is held in the outer enclosure (1) and contains the liquid detergent formulation.

Before washing laundry in a machine, the hood is removed, so that the container is then available in the form illustrated in FIG. 12. The container as such is then placed in the drum of a machine for washing laundry. The liquid detergent (15) diffuses through the holes (7), while the contents (16) of the inner compartment (4) simultaneously pass through the orifice (11). The technical problem which is posed is thus solved by a washing process in which simultaneous use is made of two products which have been packaged separately in order to avoid any detrimental interaction if the products involved are not sufficiently compatible, as is the case with peroxidic additives and liquid washing aids.

The above description has been given merely by way of illustration. It is obvious that containers comprising compartments which are more than two in number may be employed for the process of the present invention. It then suffices to insert other compartments inside the inner compartment (4), using the same method as that illustrated in FIGS. 7 through 12.

Similarly, containers of overall spherical shape have been shown in the drawings since the latter is the most suitable for use in the drums of machines for washing laundry. Nevertheless, it would be completely possible for the containers to have a different shape, bearing in mind the use of a blowing process. In all cases, the walls bounding the various compartments of the container are impervious to the aqueous medium and to the liquid products usually employed in washing, cleaning or rinsing processes. In fact, the concept of the container for making use of the process according to the invention is based, on a directed distribution through the openings with which the compartments are respectively provided.

It will also be noted that the manufacture of the container, which is illustrated in FIGS. 7 through 12, may be modified. For example, the filling of the container may be performed once the inner compartment has been fabricated. Furthermore, the holes (7) may be made beforehand in the upper flange (5a) of the plastic sheath (13).

The invention also relates to a container for making use of the washing process, the container comprising a plurality of compartments, each of which is intended to receive a substance - or mixture of substances—which can be used in washing, but which do not exhibit a satisfactory compatibility with the substances in the other compartments, each of the latter having openings.

With a view to the use in a washing process according to the invention, the individual compartments of the container may be advantageously filled with selected constituents—or combinations of such constituents of detergent compositions. This eliminates the disadvantageous effects resulting from an inadequate compatibility of the ingredients and, furthermore, a set of effects which are advantageous for the cleaning and processing of textile fibers is obtained.

The process of the invention permits, separately and practically without any limitation, the packaging and the use of constituents or of combinations of constituents of detergent compositions. From a practical standpoint, it is frequently desirable to restrict the number of compartments in the container to two. In such case, these compartments may, for example, contain various combinations of constituents, such as granules/granules, granules/liquid and liquid/liquid.

In a preferred embodiment, the process of the invention provides for the use of a container in which one of the compartments contains a liquid detergent composition and the other a bleaching compound.

All types of liquid detergent compositions may be employed, including highly concentrated compositions containing no phosphate-based detergent adjuvant, as can liquid detergent compositions containing the customary quantities of surface-active agents and of customary phosphate and/or inorganic adjuvants.

The second compartment may be filled with a bleaching detergent agent. Examples of such bleaching agents are those containing oxygen or chlorine.

The process of the invention will be illustrated further, without being limited in any way, by the following description, which relates to a specific embodiment and demonstrates the advantages obtained in washing laundry. The outer compartment of a dispensing and distributing container of the type shown in FIG. 1 is filled with about 180 g of a liquid detergent for ordinary washing. The inner compartment is filled with about 32 g of perborate tetrahydrate and about 4 g of pellets of a peroxidic bleaching agent activator. The two-compartment container, containing the detergent formulation and the peroxygenated combination, is placed in the drum of an automatic washing machine with the textile articles to be washed. The washing cycle consists of a principal washing stage and one or more consecutive rinses.

In a very general manner, the second compartment may be o employed for dispensing any detergent ingredient which, for all sorts of reasons, cannot be incorporated into the other detergent ingredients.

Examples of detergent ingredients which may be introduced into the second compartment are, in particular: bactericides, antioxidants, polycarboxylates such as polyacrylates, peroxidic bleaching agents such as diperoxydodecanedioic acid and magnesium monoperoxyphthalate, sodium hypochlorite, enzymes, storage-sensitive species, if appropriate, including oxydo-reductases, cellulases and lipases, appropriate textile softeners such as bentonites, smectites, hectorites, tallow diamines, fatty acids, detergency adjuvants such as sodium tripolyphosphate and sodium silicates, and soil-coagulating polymers.

It will also be noted that the inner compartment may be formed by mechanical means and not by blowing. The sheath (13) is then designed in the form of a component with bellows having sufficient rigidity to allow it to be introduced through the opening (2) in the enclosure (1). The inner compartment is then formed by inserting into the sheath (13) a tool, for example tulip-shaped, capable of being actuated to constitute extending parts capable of pushing the sheath back, the latter then assuming its final shape by virtue of the presence of the bellows.

What is claimed is:

1. Single-use container for packaging substances which do not exhibit satisfactory compatability when brought together, said container comprising:

(a) a generally rigid outer enclosure of overall spherical shape defining a compartment and having an opening, said compartment being adapted to hold a liquid; and (b) an expandable inner compartment generally within said outer enclosure and having an orifice disposed peripherally to said inner compartment and said compartment defined by said outer enclosure, the mouth of said orifice being encircled by an annular flange having a plurality of holes therein which access the interior of said outer enclosure, said annular flange adjoining the edges of said opening, said inner compartment being adapted to hold a liquid and having an unexpanded position and an expanded position, the transverse dimension of said inner compartment allows passage of said inner compartment through said opening when said inner compartment is in the unexpanded position, the transverse dimension of said inner compartment being greater than said opening when said inner compartment is in the expanded position.

2. Container according to claim 1, characterized in that the outer enclosure further comprises corrugations adapted to add rigidity.

3. Container according to claim 1, characterized in that the inner compartment further comprises bellows which are axially aligned to permit the transverse dimension of said inner compartment to extend as said inner compartment changes from the unexpanded position to the expanded position.

4. Container according to claim 1, characterized in that the materials of the outer enclosure and the inner compartment are selected from the group of polymers consisting of polyethylenes, polypropylenes, polycarbonates and combinations thereof.

5. Container according to claim 1, characterized in that the outer enclosure and the inner compartment have different rigidities.

6. Container according to claim 1, characterized in that the wall thicknesses of the enclosure and of the compartment are of the order of about 0.3 to 1 mm.

7. Container according to claim 1 characterized in that said container has a plurality of inner compartments.

8. Process for producing a container according to claim 1, said process comprising:

(1) fabricating the body of an outer enclosure having an opening;

(2) filling said outer enclosure with a desired quantity of a first substance;

(3) Inserting a plastic sheath through said opening until the upper part of the sheath, having a flange of annular shape encircling the mouth of an orifice, comes to bear on the edges of the opening of the outer enclosure;

(4) fabricating an inner compartment of the container from said sheath;

(5) piercing at least one hole in the annular flange of the upper part of the inner compartment;

(6) filling the inner part with a desired quantity of a second substance.

9. Process according to claim 8, further comprising evacuating said insert while inserting said insert through said opening.

10. Process for producing a container according to claim 1, said process comprising;

(1a) fabricating the body of an outer enclosure having an opening;

(2a) inserting a plastic sheath through said opening until the upper part of the sheath, having a flange of annular shape encircling the mouth of an orifice, comes to bear substantially on the edges of the opening of the enclosure;

(3a) fabricating an inner compartment of the container from said sheath;

(4a) piercing at least one hole in the annular flange of the upper part of the inner compartment;

(5a) filling the outer enclosure with a desired quantity of a first substance by introducing the latter through said hole; and (6a) filling the inner compartment with a desired quantity of a second substance through said orifice encircled by said flange.

11. Process according to claim 10, characterized in that steps (5a) and (6a) are in any order.

12. Process according to claim 10, further comprising evacuating said insert while inserting said insert through said opening.

13. Process for producing a container according to claim 1, said process comprising:

(1b) fabricating an outer enclosure, said enclosure having a circular opening and a flat bottom;

(2b) inserting a plastic sheath having an upper part of annular shape with at least one hole through said opening until the upper part of said insert comes to bear substantially on the edges of the opening in the enclosure;

(3b) fabricating the inner compartment of the container from said sheath;

(4b) filling the outer enclosure with a desired quantity of a first substance; and (5b) filling the inner compartment with a desired quantity of a second substance.

14. Process according to claim 13, characterized in that steps (4b) and (5b) are in any order.

15. Process according to claim 13, further comprising evacuating said insert while inserting said insert through said opening.

* * * * *